United States Patent [19]

Forschner

[11] Patent Number: 4,860,900

[45] Date of Patent: Aug. 29, 1989

[54] GARMENT KIT AND METHOD OF ASSEMBLY THEREOF

[76] Inventor: Horst Forschner, Scheffelstrasse 4, 8011 Kirchheim, Fed. Rep. of Germany

[21] Appl. No.: 115,007

[22] Filed: Oct. 28, 1987

[51] Int. Cl.[4] ..... B65D 85/00; A41H 3/08

[52] U.S. Cl. ..... 206/574; 2/243 B; 33/12; 33/17 R; 206/278

[58] Field of Search ..... 2/243 A, 243 B, 243 R; 33/11-16, 17 R, 17 A, 137, 138, 140; 206/574, 575, 278

[56] References Cited

U.S. PATENT DOCUMENTS

| | | | |
|---|---|---|---|
| 869,264 | 10/1907 | Ricciardi | 33/137 R |
| 1,499,220 | 6/1924 | Katzman | 206/574 |
| 2,636,180 | 4/1953 | Gillespie et al. | 2/243 R |
| 2,636,181 | 4/1953 | Becker | 206/278 |
| 2,756,434 | 7/1956 | Rick et al. | 33/12 |
| 2,892,196 | 6/1959 | Pundyk et al. | 2/243 R |
| 2,922,167 | 1/1960 | Berlin | 2/245 |
| 3,270,421 | 9/1966 | Jones | 33/137 R |
| 4,136,452 | 1/1979 | McMillan | 33/17 R |
| 4,144,647 | 3/1979 | Mosky et al. | 33/12 |

FOREIGN PATENT DOCUMENTS

| | | | |
|---|---|---|---|
| 1966203 | 8/1967 | Fed. Rep. of Germany . | |
| 7510740 | 8/1975 | Fed. Rep. of Germany . | |
| 2345118 | 3/2075 | Fed. Rep. of Germany . | |
| 0718159 | 1/1932 | France | 2/243 R |
| 1263755 | 5/1961 | France . | |
| 1336240 | 7/1963 | France . | |
| 2368908 | 5/1978 | France . | |
| 2501477 | 9/1982 | France . | |
| 464125 | 12/1968 | Switzerland . | |
| 0285296 | 2/1928 | United Kingdom | 2/243 R |

*Primary Examiner*—Jimmy G. Foster
*Attorney, Agent, or Firm*—Nils H. Ljungman

[57] ABSTRACT

A garment kit and method of assembly thereof for sale to a consumer-wearer, for the self assembly of a garment by the consumer-wearer, said kit including a partially prefabricated garment comprising a precut fabric dimensioned to cover a plurality of sizes; said precut fabric being provided with attachment markings thereon corresponding to said plurality of sizes; and said precut fabric already being provided with at least one substantially finished detail.

20 Claims, 19 Drawing Sheets

25

25

5
24
25
8

25
26

23

30
27
28
27
30

31
29
31

32
29
12

33
21

34
22
25

35
35
25
2

36
15
1

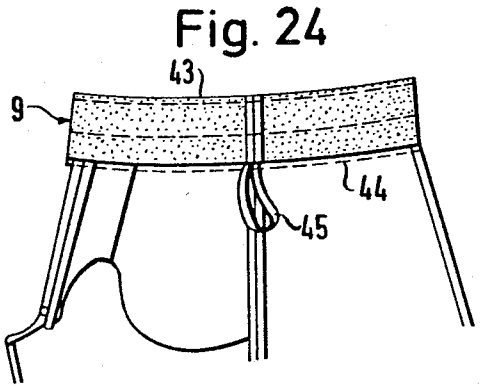
Fig. 24
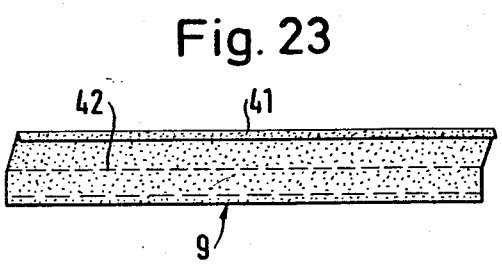
Fig. 23
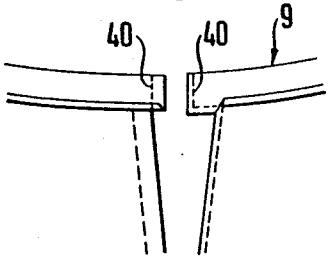
Fig. 22
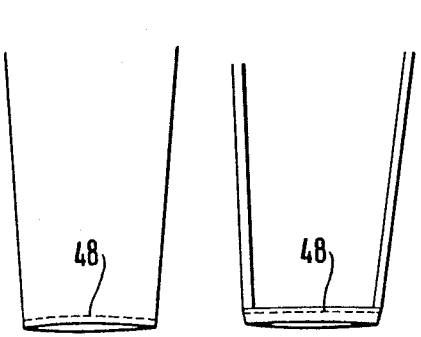
Fig. 28
Fig. 27
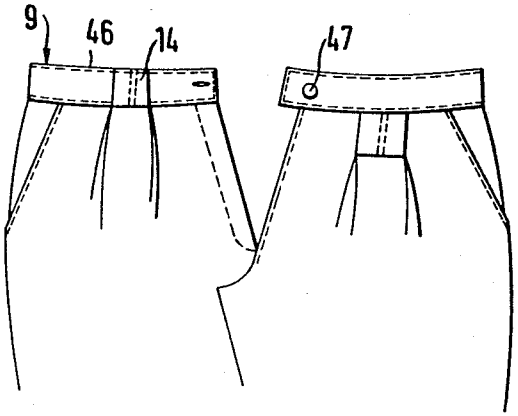
Fig. 26
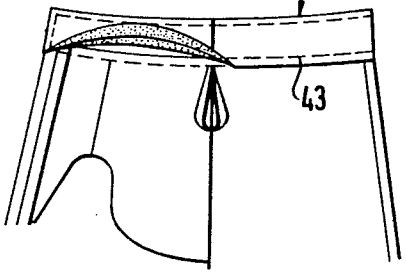
Fig. 25

GARMENT KIT AND METHOD OF ASSEMBLY THEREOF

BACKGROUND OF THE INVENTION

1. Field of the Invention

In one aspect, the present invention relates to a variable size system (covering at least three sizes) for the self assembly of clothing of all types, e.g., for ladies, men and children.

The invention is directed, in another aspect, to a component kit for the self assembly of such a garment by the consumer. Furthermore, the invention provides a method for self assembly of garments following a specifically defined product-specific sequence of steps in the preliminary production.

2. Description of the Prior Art

One method of making garments of any type and form is the industrial full production from the sketch via the cut and the following cutting to size and including the complete ready-to-wear making and subsequent pressing. In this case, the consumer only has to make his choice, from a catalog or in a retail outlet, of the articles disposed or pictured therein, but does not himself have to carry out any work on the garment. For this he must pay a substantially higher price than when making his own clothes.

Furthermore, sewing by the consumer of garments of all types by the principle of a cut pattern, cutting to size, obtaining all the accessories and individual production, is known.

The consumer is first compelled to select, in several individual actions, the cut of the garment he prefers, the material or the knitwear, the lining, the yarn and the particular fastener elements, possibly in different sales outlets. At home, the consumer then has to mark the material, cut out the material or knitwear, insert the reinforcements and attach the fastener elements.

These activities not only require a particular manual skill on the part of the consumer, but also require specific knowledge on cutting out in accordance with a pattern, on the thread course of the various materials and on the stretching properties of knitwear, as well as on the attachment of the fastener elements, such as zip fasteners, buttons, etc. These requirements consequently prevent a lot of consumers from making their own garments, in spite of the saving in costs as compared with ready-to-wear products. In addition, the consumer must have suitable equipment and devices, as well as appropriate room at home to enable him to be able to carry out all the steps from the cutting out up to the sewing together of the various cut parts without difficulties.

OBJECT OF THE INVENTION

The present invention is directed towards the provision of a variable size key over at least three sizes, a method for making clothing by the consumer himself with a very specific industrially executed sequence chain for said products and a garment kit for the self assembly of garments of all types by the consumer for ladies, men and children, which on the one hand, leaves the consumer the cost advantage of complete self production, but on the other hand, does not require either devices, machines or production and material knowledge on the part of the consumer, and permits the consumer to adapt the garment to individual variations of a standard size.

SUMMARY OF THE INVENTION

These aspects of the present invention are set forth in the appended claims.

The recited combination of several interengaging and mutually amplifying product facilities includes the possibility of providing, with a minimum of industrial preproduction (max. 30%), a garment which gives maximum benefit to the consumer and can easily be completed.

The variable component system enables the consumer, even a consumer having a difficult figure not of a standard size in ready-to-wear garments, to make for himself a garment with optimum fit, for example, to compensate, over a range of three sizes, any variations between waist and hip or between chest and waist. In addition, with combination articles (blouses, trousers, skirt, jackets) he can choose different sizes for the upper and lower parts, and order the kits giving him optimum fit advantages.

In practice, the procedure is as follows:

A consumer orders two parts of a combination dress on the basis of the variable measuring tape:

1 jacket, size 38—1 skirt, size 40

(a) she can now make the jacket in the sizes 36—38—40, in accordance with her individual size, since the individual cut parts contain corresponding dimension additions.

(b) the skirt size 40 can be made variable in sizes 38—40—42.

Important: If the body dimensions change, it is possible at any time to take every article apart, and with the additional material present, change the article to a new size.

The crux of the present inventive method is the recognition that the industrial prefabrication is suitable for fabricating the components of a garment which change only slightly over the standard sizes covered and which require, on the one hand, difficult and important working operations, and which also need specific knowledge in material working, and which, therefore, are particularly suitable for industrial prefabrication, in particular automatic production. The proportion of this part of prefabrication is about between 20 and 30 percent, including the cutting to size of the complete ready-to-wear production. The consumer is left to carry out only those activities which do not require any specific experience in making garments and which are restricted essentially to the adaptation to his measurements, the joining together, in particular the sewing together, adhering, welding, pressing, and ironing of the individual garments. Thus, compared with conventional do it yourself tailoring, the consumer saves a number of working operations which, as a rule, require specific skill and training.

A particularly great advantage is obtained by using two or three measurement systems for a corresponding number of standard sizes because, when making the garment, the consumer can take account of his individual measurements which may deviate from standard sizes.

A particular advantage of the present inventive process is that, on the one hand, the consumer saves time and money, without having to dispense with manual activities, for example, as hobby, and that the consumer is provided with preworked, intermediate-worked and finished-worked cut parts with fastener elements and accessories which he can adapt to his individual size and which are made with the necessary skill in production and material industrially, and can therefore be made available at a reasonable cost.

The present inventive process may be summarized substantially as follows:

In accordance with individual sketches of garments, such as coats, trousers, jackets, skirts, blouses or shirts, a collection of women's, men's or children's fashions is developed in matching quality and color styling, and the fabrics suitable for this purpose are defined as regards their color and material themes. From these styling sketches, technical details are then derived and separately drawn, and these details form the pattern for the subsequent cut parts.

From a particular sketch, for example, a basic cut in size 38 is developed which represents the basis for all the other sizes. Thereafter, a so-called "blank" is presewn to enable any defects in making the cut to be corrected in a fitting. Necessary changes are made directly to the basic cut. The cut parts are compared with the cut sketches, and any necessary details or changes may be made.

Now, each model is sewn in the original fabric to ensure that the cut and cloth harmonize in an optimum manner and exactly with the finished part. In this manner, any corrections which may be perceived as being necessary can be finally made to the cut.

All the working operations are cataloged and the sequences defined, separated by working operations in industrial prefabrication and the do-it-yourself work at home. The artist and technical writer subsequently coordinate the drawings and the assembly instructions.

In a parallel sequence with the cut production, the gradation of the other sizes and the combination of several dimension systems into one cut may be carried out, so as to enable a garment article to be offered in all standard sizes. After completing and checking the size sets, the latter may be, for example, stored in a cut copier. In this manner, in accordance with the sizes called up, corresponding layers can be copied out and cut to size on the cutting table. The cut parts are tidied and specific parts are supplied to further working operations. Such working operations may, for example, be the pressing-on of inserts or the preliminary sewing of pocket entries. Small finished parts may also be supplied preassembled, for example, belt loops, motifs, pleats, collars, cuffs, embroidery and slit seams, belts, pockets and waistbands.

All components, including accessories, such as yarn, zip fasteners, buttons and paddings and the respective assembly instructions are finally assembled together in a package ready for distribution in the form of a kit.

A consumer ordering such a package or kit by means of a catalog or choosing it at special distributers, may begin assembly of the components immediately with the aid of the enclosed assembly instructions. To do this, the consumer requires only a minimum of the knowledge which he would have to have had to make garments himself by conventional methods. He also does not require any special devices or special space facilities. Fundamentally, a simple sewing machine is enough, and such a machine is easy to learn to operate.

The present inventive process combines, in a particularly skillful manner, the advantages of industrial production with those of do-it-yourself, with minimum costs and good fit, the consumer's own contribution to the finished product being between 70 and 80 percent. It permits the self production of fashionable garments in a short period of time, with an optimum cost distribution between the industrial prefabrication area on the one hand, and the do-it-yourself area, on the other.

The garment kit defined in the appended claims may, for example, be marketed in foil-like transparent packages. Other known forms of presentation are, however, also conceivable, such as cardboard, bags, rolls, etc.

As is also recited in the appended claims, any appropriate accessories may be included in the packaged garment kit.

A measuring tape to be used for the individual size adaptation is specifically designed so that the consumer can read his standard size and the size in centimeters.

In one aspect, the invention features a kit for sale to a consumer-wearer, for the self assembly of a garment by the consumer-wearer, said kit comprising: a partially prefabricated garment comprising a precut fabric dimensioned to cover a plurality of sizes; said precut fabric being provided with attachment markings thereon corresponding to said plurality of sizes; and said precut fabric already being provided with at least one substantially finished detail.

In another aspect, the invention features a method for the self assembly of a garment by a consumer-wearer, said method comprising the steps of: a) obtaining a kit, said kit comprising a partially prefabricated garment comprising a precut fabric dimensioned to cover a plurality of sizes, said precut fabric being provided with attachment markings thereon corresponding to said plurality of sizes, and said precut fabric already being provided with at least one substantially finished detail; and b) choosing at least one of said plurality of sizes to be the finished size of said garment; and c) assembling said precut fabric along said attachment markings corresponding to said chosen size.

In a further aspect, the invention features a method for the making of garments, such as coats, trousers, jackets, skirts, blouses or shirts, by the consumer himself, wherein firstly a garment as regards its components is cut and partially worked in that cut parts possibly with worked-on reinforcements are provided in a predetermined article-specific industrial prefabrication with finished seams which need not be changed afterwards, with fastener elements and with accessories, and thereafter the garment is put together in the form of a package in kit-like manner with matching of the cut, material and color, and from said package the consumer, on the basis of the components of the package in accordance with assembly instructions connects the components in accordance with their purpose and completes the garment, and wherein the individual cut parts of a package are made in a size covering a plurality of standard sizes, and wherein the respective dimensions corresponding to the standard sizes covered are marked on the cut parts, and wherein the industrial prefabrication work is carried out in the form of worked-in reinforcements or worked-on and worked-in parts, such as pockets, collars, zip fastener, etc., finished seams and button holes, etc., which for the standard sizes covered do not change or change only slightly, and wherein the consumer measures his standard size and designates the corresponding markings on the cut parts prior to the connecting of the parts to form the garment in accordance with the instructions.

In yet another aspect, the invention features a component kit for the making of a garment, for example, coat, trousers, jacket, skirt, blouse or shirt, by the consumer himself, wherein industrially prefabricated components, matching each other in cut, material and color, put together in the form of a package in kit manner, said components comprising preworked, intermediate-worked and finished-worked cut parts, possibly with worked-on reinforcements, worked-in parts, fastener elements and accessories, said package including assembly instructions and a combination measuring tape.

The invention will now be explained in detail, with reference to an example of embodiment illustrated in the drawings, wherein:

BRIEF DESCRIPTION OF THE DRAWINGS

FIGS. 13–28 show various situations in the manual sewing kit final making of pleated waist trousers;

FIG. 1 shows the various components and the layout pattern 1–15 of pleated waist trousers.

DESCRIPTION OF THE PREFERRED EMBODIMENT

Figure 1:
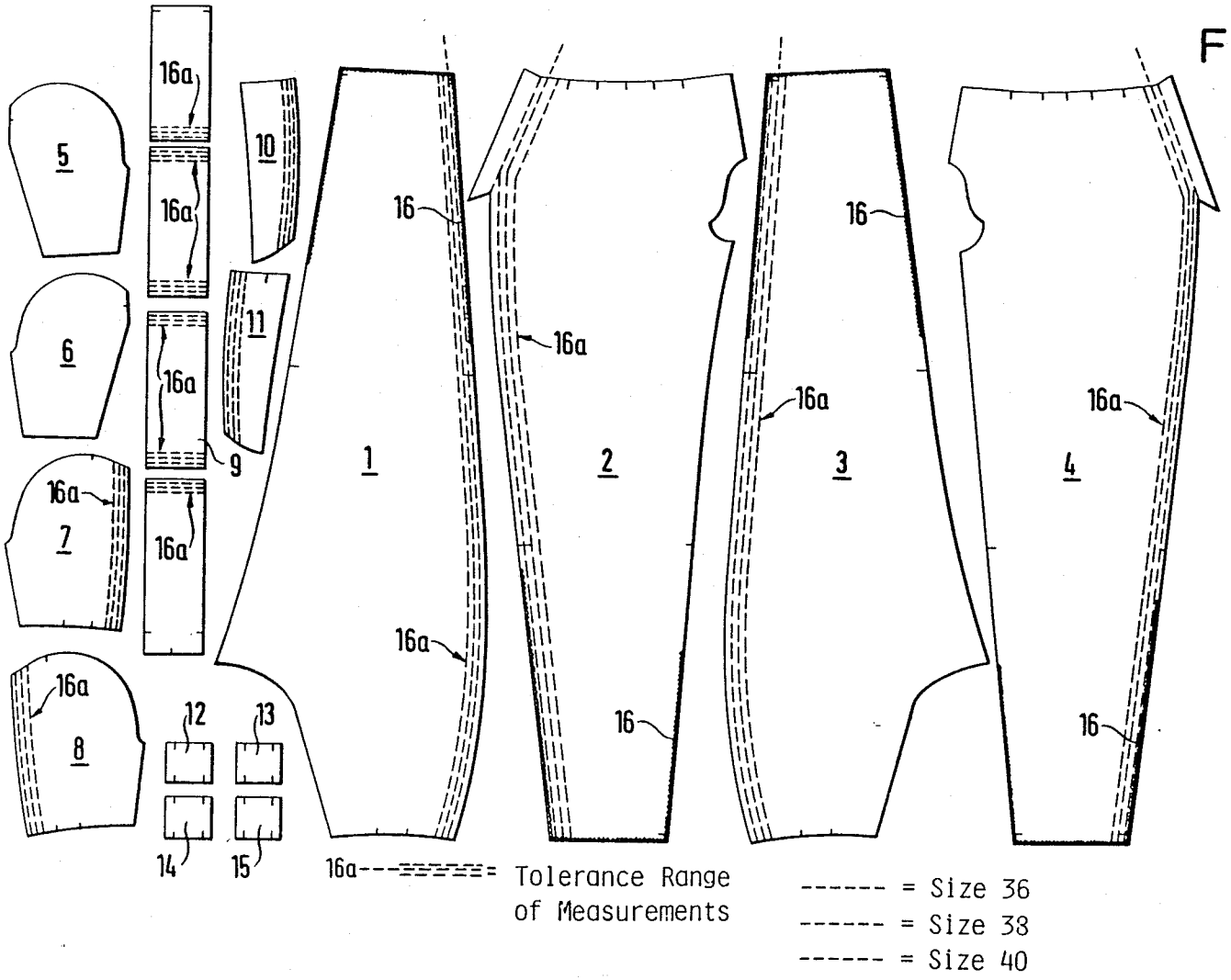
FIG. 1 is a component set for pleated waist trousers without accessories and sewing yarn.

Referring now to the attached drawings, and most particularly to FIG. 1, in an industrially prefabricated garment kit, according to the invention, the two front portions of legs 2, 4 and the two rear portions of legs 1, 3 are provided with peripheral finishing or tidying seams 16. This is a finished part of the purchased product which is completed in a partial manner. Each cut part includes three sizes, the center line of which corresponds to the ideal measurement, for example, of size 38. The inner line corresponds to size 36, and the outer line to size 40. Since the parts are tidied, it is advisable not to cut off the excess width of the dimension addition 16*a*, but to leave it should any changes in size become necessary.

Figure 4:
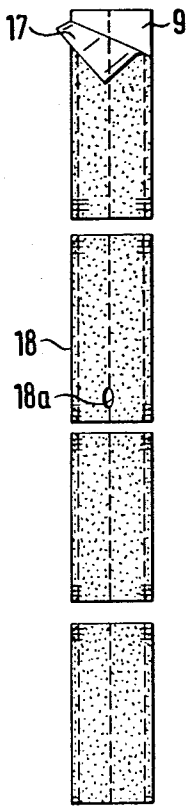
FIGS. 2–12 show different situations of the industrial sewing set prefabrication of pleated waist trousers.

Following this, as is shown most particularly in FIG. 4, the inserts 17 are ironed onto the trouser waistband parts 9. These steps represent finishing of medium scope (intermediate working). The variable waistband makes it possible to prefabricate the button hole 18*a* on the waistband.

Figure 5:
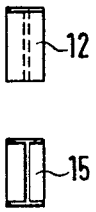

The band loops 12–15 according to FIGS. 1 and 5 are finished by tidying, sewing over, cutting and ironing.

Figure 2:
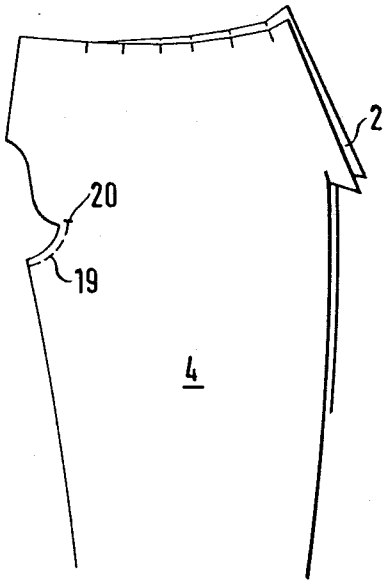

FIG. 2 shows that the two front portions of legs 2, 4 are sewn together at the front center portion 19 up to the snip 20. This is again a finish of smaller scope.

Figure 3:
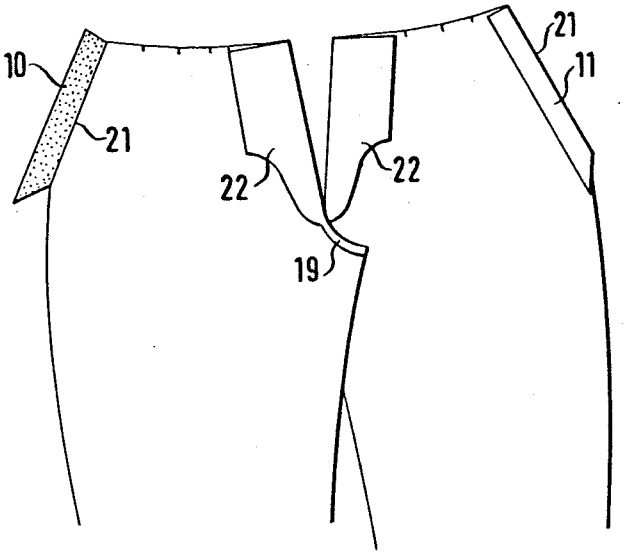

FIG. 3 shows the attachment of the inserts 10, 11 to the pocket entrances 21. Firstly, the inserts 10, 11 are ironed on and then the pocket edges ironed over. It is also apparent from FIG. 3 that the two zip fastener edge borders 22 are ironed over.

Figures 6, 7, 8, 9, 10:
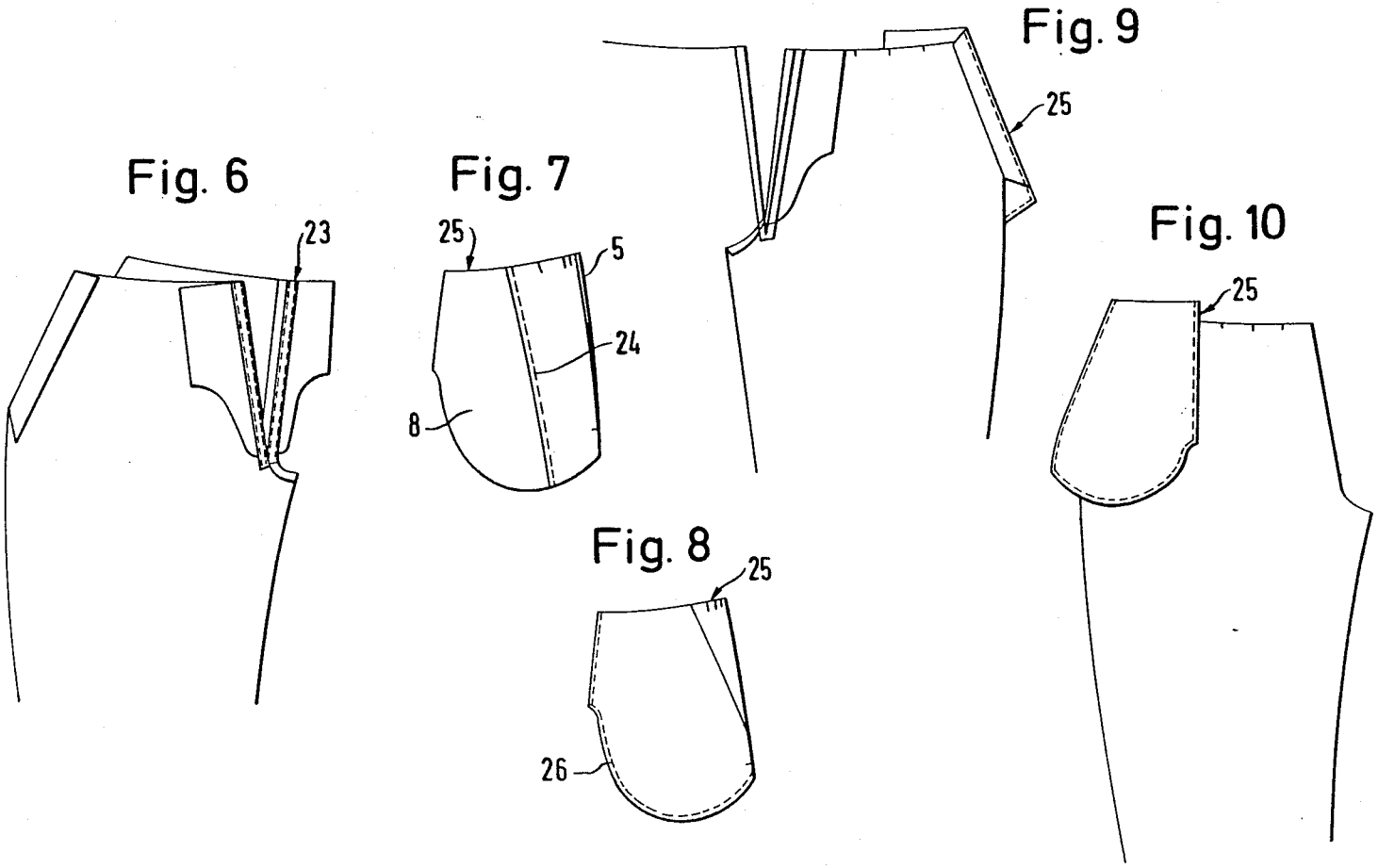

Now, in accordance with FIG. 6, the zip fastener 23 is sewn in with a two-needle machine.

FIG. 7 shows the sewing in of the lower pocket part 5 on a lining pocket part 8 and the chain-stitching 24. A lining pocket part 25 is formed.

Thereafter, in accordance with FIG. 8, both lining pocket parts 25 are placed against each other and closed all round with safety stitch 26.

Figure 11:
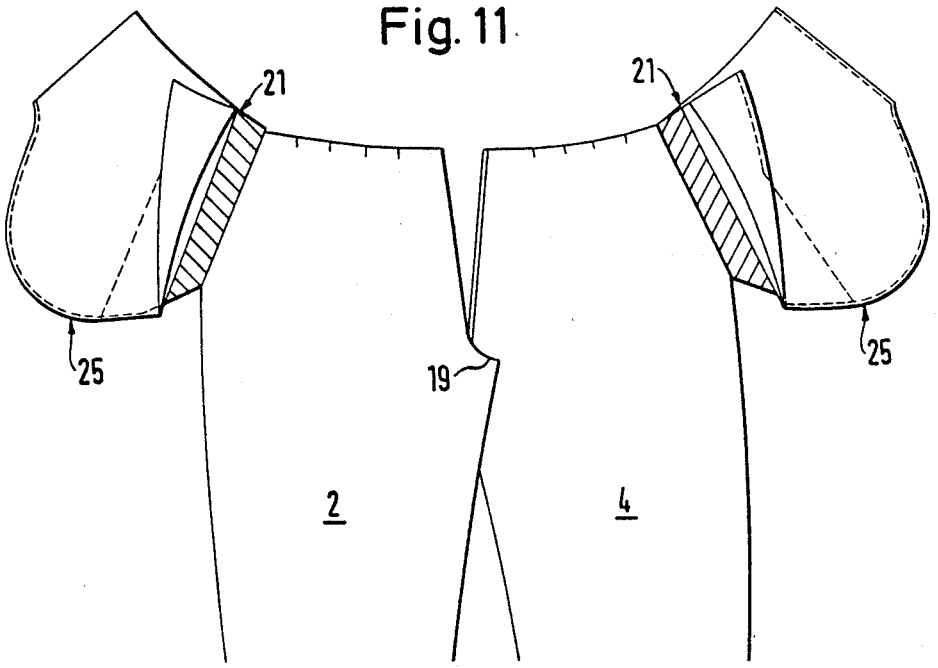
Figure 12:
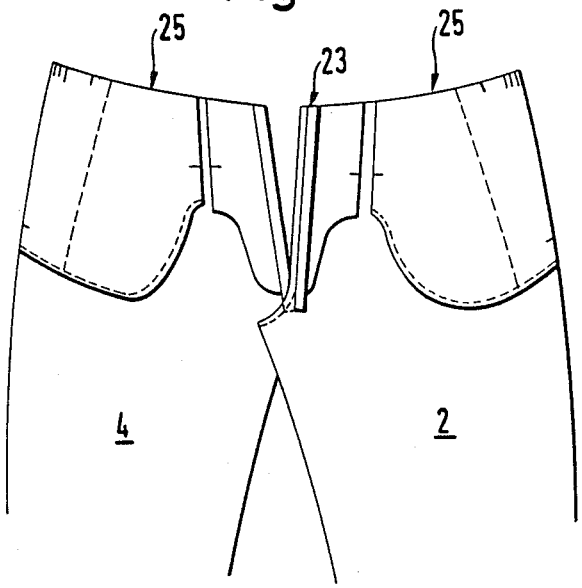

It can then be seen from FIGS. 9–12 that the pocket bags 25 are sewn with safety stitches 26 to the pocket entrance 21. FIG. 11 is a view of the right or outer side of the front portions of legs 2, 4, and FIG. 12 is a view of the wrong or inner side of the front portions of legs 2, 4.

This concludes the industrial prefabrication. This product is made available to the consumer in the form of a kit for do-ityourself assembly.

After opening the kit package and reading the assembly instructions, the consumer will first determine, with the aid of the measurement table, the corresponding size seam of the variable system in order to obtain his optimum size and fit in the garment to be assembled. Thereafter, in accordance with FIG. 13, the presewn zip fastener 23 (not shown) is provided with two quilted seams 27 and locked by means of a cross seam 28.

Figures 13, 14, 15, 16, 17, 18, 19:
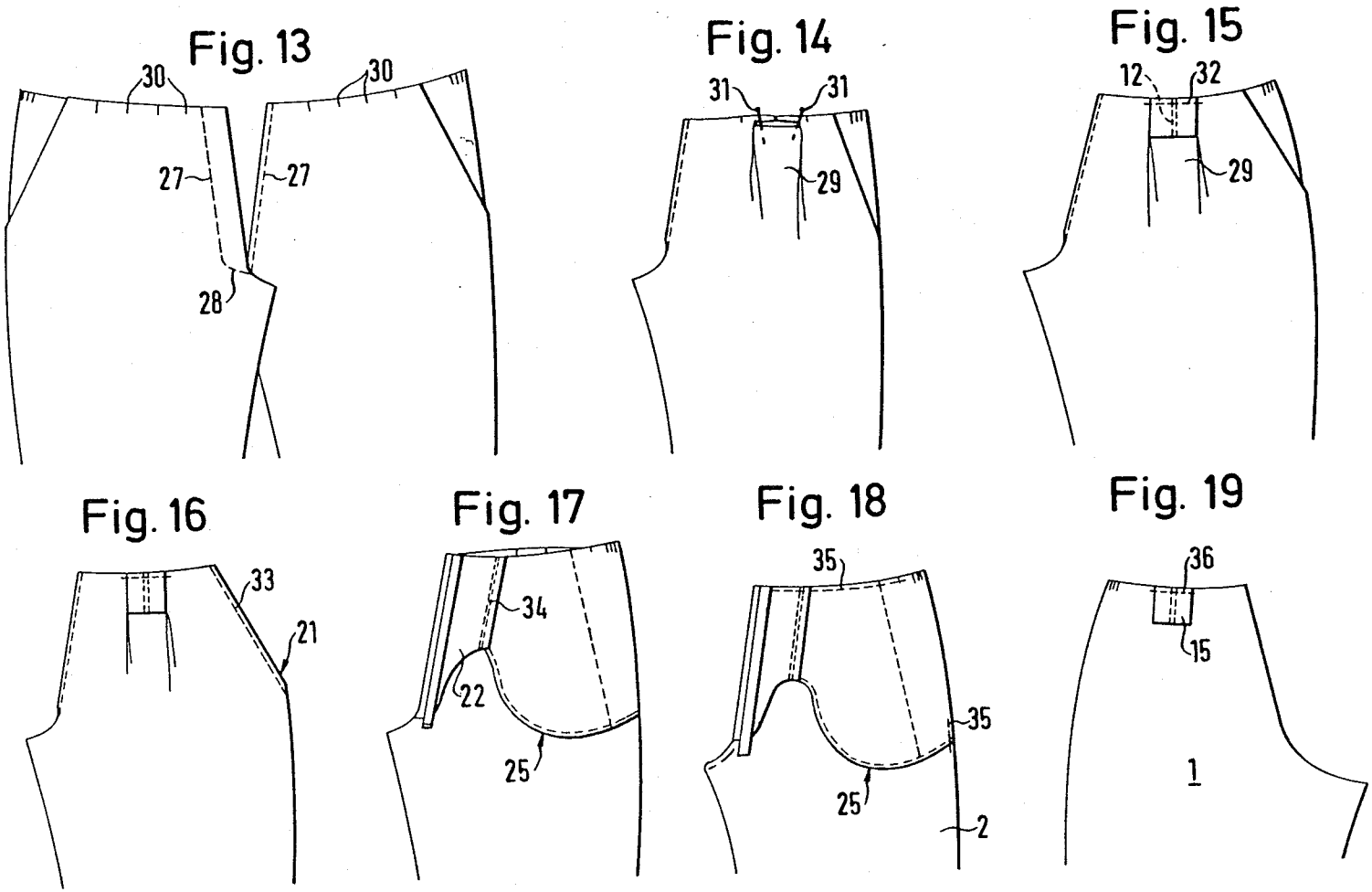

Then, the waistband folds 29 are pinned according to markings 30 by means of needles 31, and then the belt loops 12–15 placed between the pleats (FIG. 15). Thereafter, the belt loops 12–15 are secured by means of a seam 32.

In accordance with FIG. 16, the next working operation resides in forming the quilted seams 33 at the upper edge of the pocket entrances 21.

Then, double seams 34 are formed at the connection between the pocket bags 25 and the zip fastener border 22 (FIG. 17).

Four short seams 35 are then made in accordance with FIG. 18 to attach the pocket bags 25, at the waist and at the side, to the front portions of legs 2, 4.

In accordance with FIG. 19, two short seams 36 are then to be formed to sew the belt loops 12–15 to the rear portions of legs 1, 3.

Figure 20:
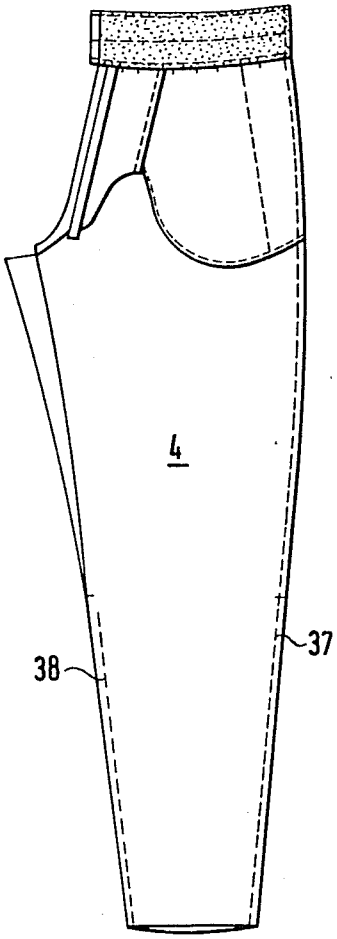

In accordance with FIG. 20, the front portions of legs 2, 4 and rear portions of legs 1, 3 are now sewn together at the sides 37 and in the crotch 38. Short incisions in the material assist here as markings and ensure exactly the matching and placing together of the corresponding parts.

Figure 21:
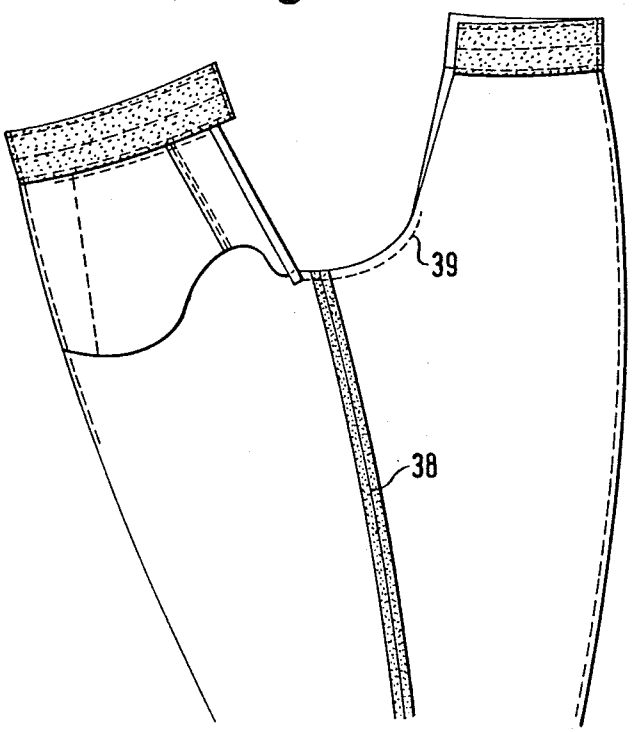

After the sewing together of the front portions of legs 2, 4 and rear portions of legs 1, 3 in accordance with FIG. 21, the seat seam 39 is closed and locked. Thereafter, all the seams so far formed are ironed flat. This is also apparent, for example, from FIG. 21.

In accordance with FIG. 22, the consumer must now form on the trouser waistband 9, two inverted seams at the edges, iron the waistband edges 41 in accordance with the assembly instructions and pleat iron the center 42, as shown in FIG. 23.

Thereafter, the band 9 still open at the lower side 43 is sewn onto the trouser waist seam 44 in accordance with the illustration of FIG. 24. As this is done, two loops 45 are also sewn at the sides.

As is apparent from FIG. 25, the band 9 is then folded up inwardly. Thereafter, the band inner side is pinned and stitched all around from the right side. As is also apparent from FIG. 26, the upper edge 46 of the band 9 is stitched through all around, the belt loops being placed over the band 9 in accordance with FIG. 26, and the upper loop edge being tucked in 1 cm and stitched to the band 9.

Thereafter, corresponding to the waist measurements of the consumer, the button 47 is attached to the waistband 9. [See also, in this regard, FIG. 26].

FIGS. 27 and 28 show the sewing inwards of the trouser hem 48 after determining the length measurement.

Figure 29:
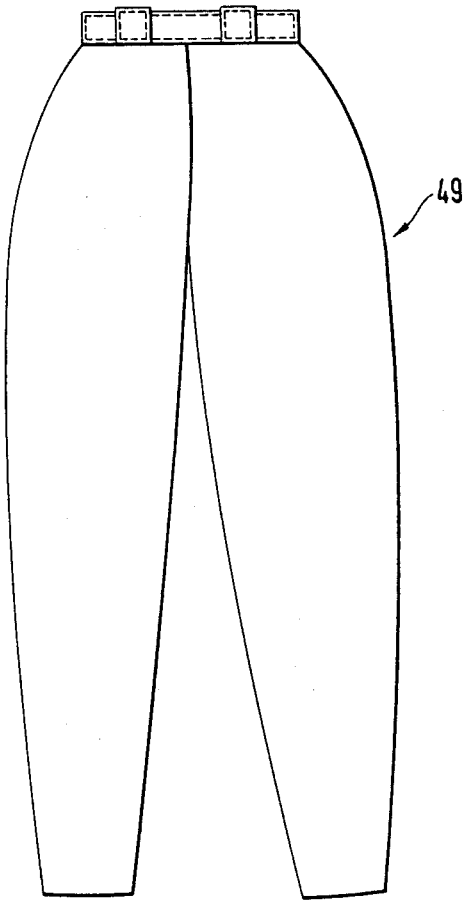
FIG. 29 shows the rear view.
Figure 30:
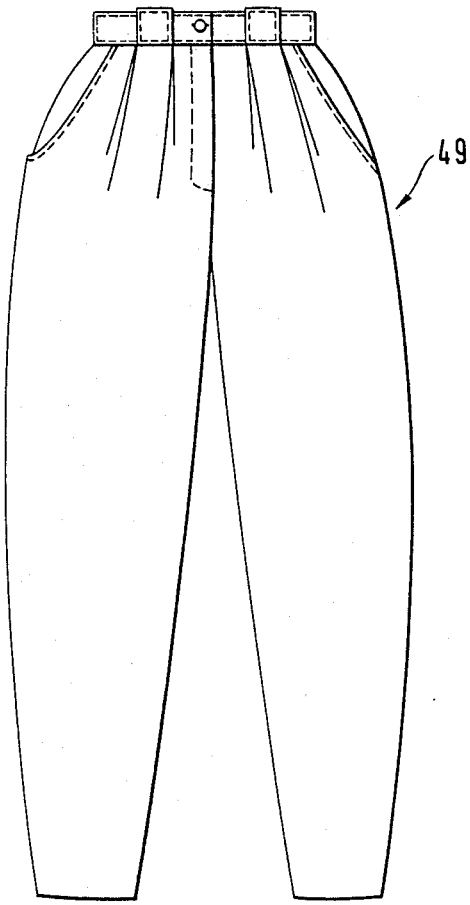
FIG. 30 shows the front view of the finished pleated waist trousers.

The finished trousers 49, as shown in FIGS. 29 and 30, are now turned inside out and all the remaining seams are ironed out. The trousers are then finally pressed from the right side.

The form of the adaptation of the longitudinal seams to the measurements of the consumer explained above applies accordingly also to the adaptation of cross seams and length measurements.

Although the working sequence has been explained above only with reference to trousers, it will be appreciated that an analogous procedure applies accordingly to all other types of garments. Differences arise only as regards the article-specific working sequence.

The invention as described hereinabove in the context of the preferred embodiment is not to be taken as limited to all of the provided details thereof, since modifications and variations thereof may be made without departing from the spirit and scope of the invention.

What is claimed is:

1. An industrially prefabricated garment kit of a plurality of kits, said plurality of kits being in a plurality of different garment sizes over a substantial range of garment sizes for sale to a consumer-wearer, for the self assembly of a garment by the consumer-wearer, said kit comprising:

a partially industrially prefabricated garment comprising at least one industrially prefabricated precut fabric garment piece dimensioned to cover a plurality of sizes;

said at least one precut fabric piece being provided with attachment markings thereon corresponding to said plurality of sizes; and said precut fabric already being provided with at least one substantially finished, industrially prefabricated, structural detail of said garment being industrially sewn on at least one of said at least one industrially prefabricated precut fabric piece;

said plurality of garment size attachment markings being of a smaller number of sizes than the number of sizes of said range of garment sizes.

2. The kit according to claim 1, wherein said at least one substantially finished industrially prefabricated structural detail comprises at least one of: reinforcement, a pocket, a collar, a fastener, a zip fastener, a substantially finished seam and a button hole.

3. The kit according to claim 2, wherein the amount of prefabrication of said garment is a maximum of 30% of the total fabrication of the completed garment.

4. The kit according to claim 2, said kit further comprises a combination tape measure having thereon markings corresponding to said plurality of sizes and markings corresponding to standard dimensions of length.

5. The kit according to claim 4, said kit being packaged and further comprising assembly instructions and accessories for attachment to said precut fabrics.

6. The kit according to claim 1, wherein said at least one substantially finished detail is provided on said precut fabric at a location which is substantially constant over said plurality of sizes of the garment sizes of the range of produced garment sizes.

7. The kit according to claim 1, wherein the amount of prefabrication of said garment is a maximum of 30% of the total fabrication of the completed garment.

8. The kit according to claim 1, said kit further comprises a combination tape measure having thereon markings corresponding to said plurality of sizes and markings corresponding to standard dimensions of length.

9. The kit according to claim 8, said kit being packaged and further comprising assembly instructions and accessories for attachment to said precut fabrics.

10. A method for the self assembly of a garment by a consumer-wearer from a kit, said method comprising the steps of:

a. industrially prefabricating a kit in production with other such kits;

said production comprising:

(I) making a plurality of precut fabric pieces for kits, said kits being made over a predetermined range of garment sizes;

(II) each said kit comprising a partially prefabricated garment comprising at least one precut fabric dimensioned to cover a predetermined plurality of sizes;

(III) providing said pre-cut fabric with attachment markings thereon corresponding to said plurality of sizes; and (IV) providing said at least one precut fabric with at least one substantially finished structural detail during said production; and b. obtaining said kit;

c. choosing at least one of said plurality of sizes to be the finished size of said garment in said kit; and d. assembling said precut fabric along said attachment markings corresponding to said chosen size of step (c);

said plurality of size attachment markings being of a smaller number of sizes than the number of sizes of said range of garment sizes.

11. The method according to claim 10, wherein said at least one substantially finished industrially prefabricated structural detail comprises at least one of: a reinforcement, a pocket, a collar, a fastener, a zip fastener, a substantially finished seam and a button hole.

12. The method according to claim 11, wherein said at least one substantially finished detail is provided on said precut fabric at a location which is substantially constant over said plurality of sizes of a first range of the total range of produced garment sizes.

13. The method according to claim 11, wherein the amount of prefabrication of said garment is a maximum of 30% of the total fabrication of the completed garment.

14. The method according to claim 11, said kit further comprising a combination tape measure having thereon markings corresponding to said plurality of sizes and markings corresponding to standard dimensions of length, and choosing at least one size according to a measurement measured with said combination tape measure.

15. The method according to claim 10, wherein said at least one substantially finished detail is provided on said precut fabric at a location which is substantially constant over said plurality of sizes of a first range of the total range of produced garment sizes.

16. The method according to claim 10, wherein the amount of prefabrication of said garment is a maximum of 30% of the total fabrication of the completed garment.

17. The method according to claim 10, said kit further comprising a combination tape measure having thereon markings corresponding to said plurality of sizes and markings corresponding to standard dimensions of length, and choosing at least one size according to a measurement measured with said combination tape measure.

18. The method according to claim 17, said kit being package and further comprising assembly instructions and accessories for attachment to said precut fabrics.

19. The method according to claim 14, said kit being packaged and further comprising assembly instructions and accessories for attachment to said precut fabrics.

20. A plurality of industrially prefabricated garment kits, said plurality of kits for the same kind of garment being in a plurality of different garment sizes over a substantial range of garment sizes, said plurality of kits being for sale to consumer-wearers, for the self assembly of a garment by the consumer-wearers, substantially all of said kits each comprising:

a partially industrially prefabricated garment comprising at least one industrially prefabricated precut fabric garment piece dimensioned to cover a plurality of sizes;

said at least one precut fabric piece being provided with attachment markings thereon corresponding to said plurality of sizes; and said plurality of size attachment markings on any one piece being of a smaller number of sizes than the total number of sizes of said range of sizes;

said precut fabric already being provided with at least one substantially finished, industrially prefabricated, structural detail of said garment which is industrially sewn on at least one of said at least one industrially prefabricated precut fabric piece;

said at least one substantially finished, industrially prefabricated, structural detail being substantially similar on a substantially number of different kit sizes in said range;

said structural detail, over a first range of said range of sizes, being in substantially the same position on the corresponding garment pieces in the first part of said range of garment sizes;

the garment sizes of said first part of said range of garment sizes being greater in number than the number of the size attchment markings indicating different sizes on any one garment piece.

* * * * *